US005410822A

United States Patent [19]

Vaccari

[11] Patent Number: 5,410,822

[45] Date of Patent: May 2, 1995

[54] SKI BOOT WITH TOE PIECE AND OVERLAPPING FLAP

[75] Inventor: Franco Vaccari, Montebelluna, Italy

[73] Assignee: Dolomite S.p.A., Montebelluna, Italy

[21] Appl. No.: 316,389

[22] Filed: Sep. 30, 1994

Related U.S. Application Data

[63] Continuation of Ser. No. 137,277, Oct. 14, 1993, abandoned.

[30] Foreign Application Priority Data

Oct. 16, 1992 [EP] European Pat. Off. ..... 92830576

[51] Int. Cl.[6] ..... A43B 5/04

[52] U.S. Cl. ..... 36/117; 36/54

[58] Field of Search ..... 36/117-121, 36/50.5, 54, 109, 114, 77 R, 77 M

[56] References Cited

U.S. PATENT DOCUMENTS

| | | | |
|---|---|---|---|
| 4,574,499 | 3/1986 | Olivieri | 36/120 |
| 5,031,340 | 7/1991 | Hilgarth | 36/119 |
| 5,054,214 | 10/1991 | Sartor | 36/119 |
| 5,189,815 | 3/1993 | Pozzobon et al. | 36/120 |
| 5,193,294 | 3/1993 | Pozzobon et al. | 36/120 |
| 5,228,219 | 7/1993 | Tonel | 36/117 |

FOREIGN PATENT DOCUMENTS

| | | |
|---|---|---|
| 365428 | 1/1982 | Austria . |
| 1587712 | 3/1970 | France . |

*Primary Examiner*—Steven N. Meyers
*Assistant Examiner*—Thomas P. Hilliard
*Attorney, Agent, or Firm*—Edward D. Manzo; Ted K. Ringsred

[57] ABSTRACT

A sport shoe such as a ski boot having a shell with a notch extended to near the toe region thereof and a strip bridging the notch and being adapted to be tightened onto the shell to close it, is provided with a toe piece adapted to overlie the shell at the toe region; the toe piece has a lug which intervenes, in use, between the strip and the shell to tighten the toe piece onto the shell through said strip.

7 Claims, 2 Drawing Sheets

Fig. 1
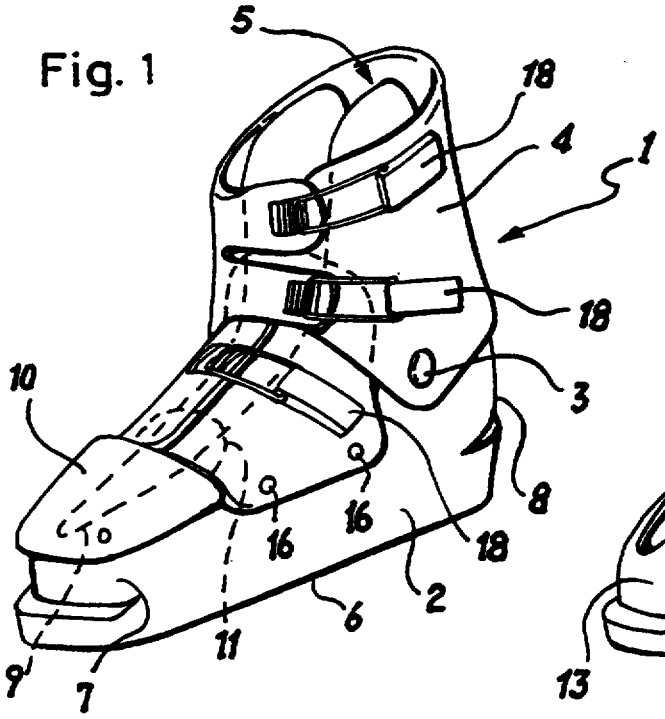
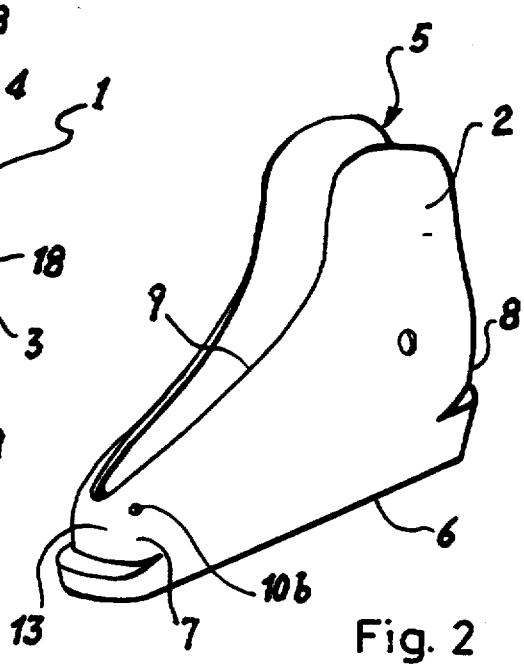
Fig. 2
Fig. 3
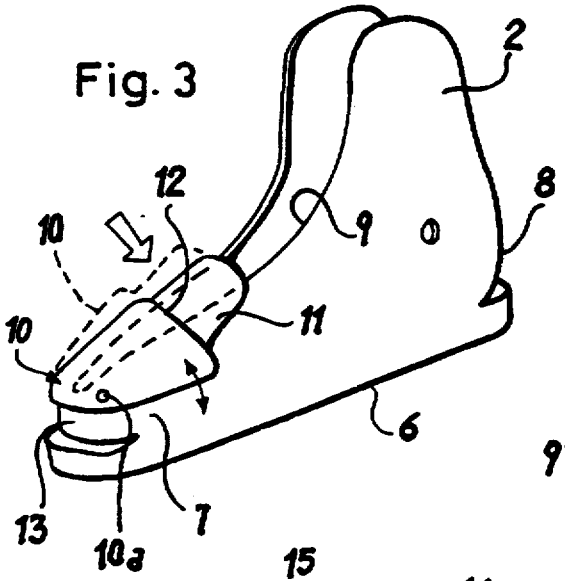
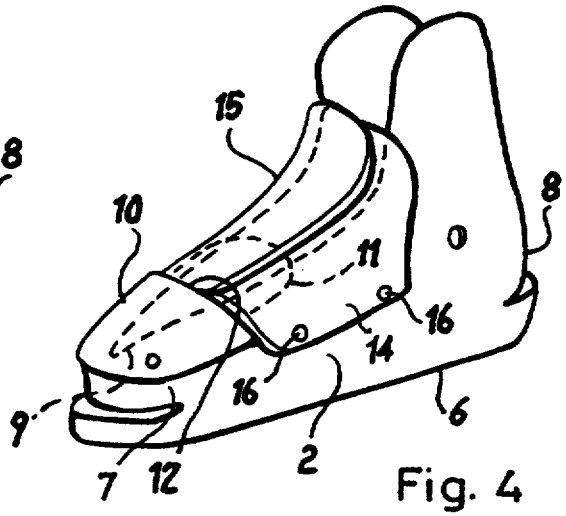
Fig. 4
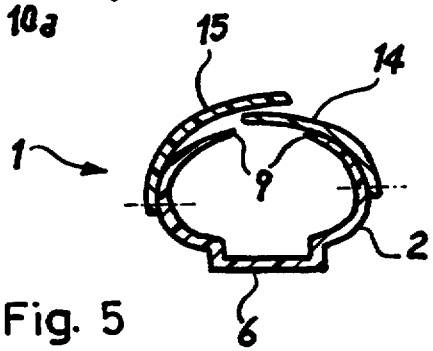
Fig. 5
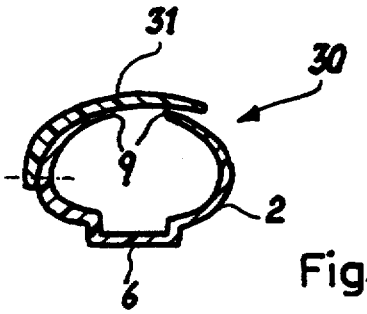
Fig. 6

SKI BOOT WITH TOE PIECE AND OVERLAPPING FLAP

This is a file wrapper continuation application of application Ser. No. 08/137,277 filed on Oct. 14, 1993, now abandoned.

This invention relates to a sport shoe, in particular a ski boot, being of a type which comprises:

- a shell having longitudinally opposed toe and heel regions,
- a notch formed in the shell and being extended to the vicinity of the toe region thereof,
- at least one strip bridging said notch and being adapted to be fastened onto said shell so as to close it.

Boots provided with the above features are well known on the market. They usually have a notch which extends forwardly over the top of the foot, from the entrance port of the shell to near the toe end. In a first boot type, the notch is defined between two overlapping strips carrying appropriate fastening members, such as the lever type disclosed in U.S. Pat. No. 3,494,054.

In another prior embodiment, the notch is U-shaped, extends from an intermediate region between the toe and the entrance port of the shell, and is closed removably by a stiff flap which is fastened onto the shell by means of one or more lever fasteners.

Both boot types indicated hereinabove have some drawbacks for the wearer. For instance, it is comparatively difficult to prevent water from seeping into the boots of the first-mentioned type, especially near the shell toe end where the strips separate from the shell. Further, this area is likely to develop cracks due to the tear forces that are bound to develop on strips which jut tangentially out from the shell and are integral moldings therewith. Also, it has been found that the tight hold on the foot is relatively ineffective at the toe portion because the shell structure prevents the notch which defines the overlapping strips from being extended throughout to the toe region of the shell. This region is, therefore, stiff and unlikely to clamp the foot properly, even where a powerful fastening force can be applied through the lever fasteners. In addition, the choice of the material used to make the entire shell is dictated by the need to limit the above-noted problems. Thus, to improve the shell fit on the wearer's foot and the donning ability, preference is given to suitably soft materials, which are also comparatively heavyweight and expensive, however.

The water seepage problem is manifest, although for different reasons, also in boots of the second-mentioned type. The only arrangement provided here to make the shell liquid-tight is, in fact, a seal mounted between the flap and the shell. However, since the flap is only tightened locally on the shell, in the presence of the lever fasteners, it is required that the same be quite stiff, such that the fastening pressure can be spread over the edges of the notch to provide sufficient compression of the seal. This clashes with the need to have the boot relatively flexible, especially in the area of pivotal connection between the shell and the bootleg. Additionally, owing indeed to these difficulties of providing a liquid-tight fit between the flap and the shell, the notch extent toward the shell toe end must be minimum consistently with the need to allow the boot to be entered comfortably. It follows also in this case that the wearer's foot will be clamped unevenly in the toe region of the shell.

The underlying problem of this invention is to provide a ski boot, or the like sport footwear, whose construction and performance can obviate the drawbacks with which the aforementioned prior art is beset.

This problem is solved according to the invention by a sport shoe as indicated in the preamble being characterized in that it comprises a toe piece adapted to overlie the shell in the toe region thereof, said toe piece having a lug which intervenes, in use, between the strip and the shell to clamp said toe piece onto the shell through said strip.

BRIEF DESCRIPTION OF THE DRAWINGS

In the interest of a better understanding of this invention, an exemplary and non-limitative embodiment thereof will be described herein below which is depicted in the accompanying drawings, where:

FIG. 1 is a perspective view showing schematically a ski boot according to the invention;

FIGS. 2 to 4 are perspective views illustrating the assembly sequential steps of the boot in FIG. 1;

FIG. 5 is a perspective view corresponding to FIG. 4, showing schematically a variation of the inventive boot;

FIGS. 5 and 6 are cross-sectional views of the boot shell in FIG. 1 and a variation thereof, respectively;

For convenience of illustration, similar parts are denoted by the same reference numerals throughout the drawings.

DESCRIPTION OF THE PREFERRED EMBODIMENTS

Figure 10:
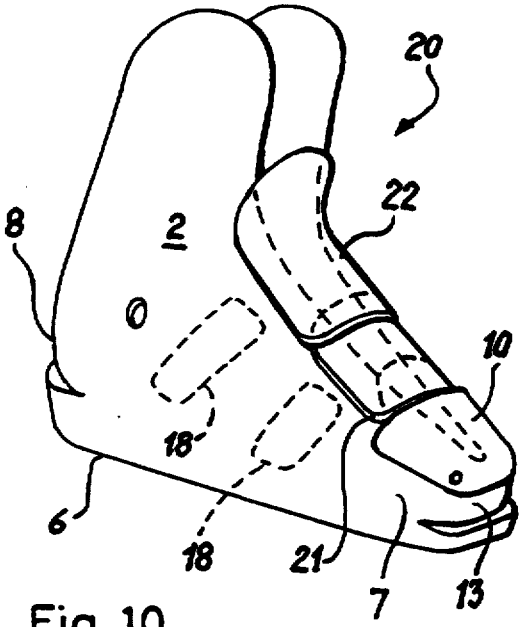
FIGS. 9 and 10 are perspective views of the inboard side and the outboard side relative to the position in use, respectively, of a further variation of the invention.

With reference to FIG. 1, a ski boot generally shown at 1 comprises a shell 2 having a bootleg 4 mounted thereon in an articulatable manner by means of pivot pins 3. The bootleg 4 encircles an entrance port 5 of the boot which locates opposite to a sole 6.

Respectively provided on the shell 1 are a toe region 7 and a heel region 8 opposing each other. A notch 9 is formed in a top region of the shell, opposite to the sole 6, and extends from the toe region 7 to the entrance port 5, with edges which diverge gradually V-like.

Figure 8:
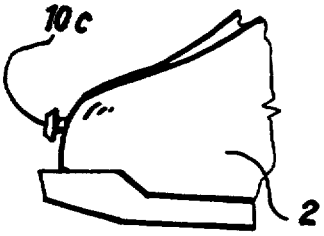
FIGS. 7 and 8 are perspective and side elevation views, respectively, of a modified detail of FIG. 3.
Figure 7:
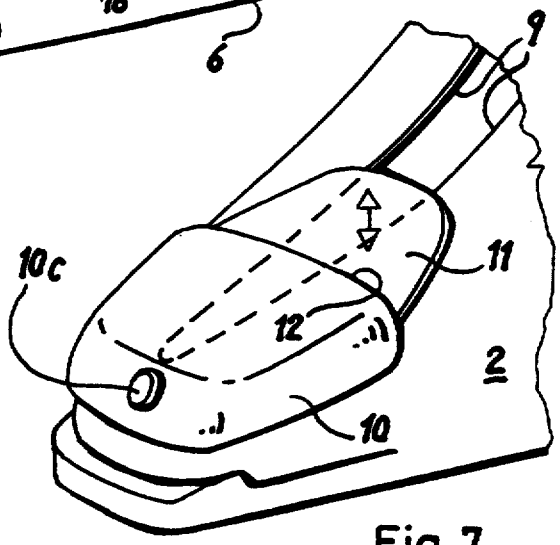

A toe piece 10 (FIG. 3) is attached to the shell 2 in overlying relationship with the toe region 7. The toe piece 10 is secured on the shell in a rocking fashion toward and away from the toe region by means of a single dowel or rivet **10*a* engaged in a hole 10*b* in the shell 2. Alternatively, the toe piece may be secured by a mushroom formation 10*c* (FIGS. 7 and 8**) projecting from the shell and engaging by snap action in a corresponding hole in the toe piece.

It should be noted that, as further explained hereinafter, the shape of the toe piece 10 surface lying next to the shell mates with the corresponding profile of the shell, with the latter clamped onto the wearer's foot; with the boot 1 opened, the toe piece 10 will, therefore, be slightly narrower than the shell in the transverse direction of the notch 9.

The toe piece 10 is provided with a lug 11 on the opposite side from the toe region 7. The lug 11 is sunk stepwise with respect to the toe piece to define a shoulder 12. Notice that the notch 9 extends a substantial distance through the toe region of the shell, to the proximity of the apex 13 thereof, and is completely covered, over the pertinent section, by the toe piece 10 and the lug 11.

The boot 1 further comprises two strips 14, 15 added to the shell 2, to which they are attached as by means of rivets 16. Said strips bridge the notch 9 from the respective opposed lateral sides of the shell 2, and overlap each other at the notch to completely close the pertinent side of the latter, they being terminated beneath the bootleg 4.

To tighten said strips 14, 15 over each other, conventional lever fastener means 18 (of which only one is shown, although they may be two or more in number) are provided, and like fastener means 18 are provided conventionally on the bootleg 4.

The aforementioned strips, once tightened onto the shell to overlie the lug 11, locate close against the shoulder 12, thereby re-establishing the toe piece surface continuity. By tightening the strips 14, 15 over each other through the lever fasteners 18, the shell will be clamped onto the wearer's foot to a required locked condition, and will concurrently shrink over the toe region 7 to mate with the inside profile of the toe piece 10. In this condition, the toe piece fits in mating relationship over the toe region 7 and tightly onto the shell owing to the pressure exerted by the aforementioned strips on the lug 11, thereby the notch 9 portion underlying it is closed tight.

Figure 9:
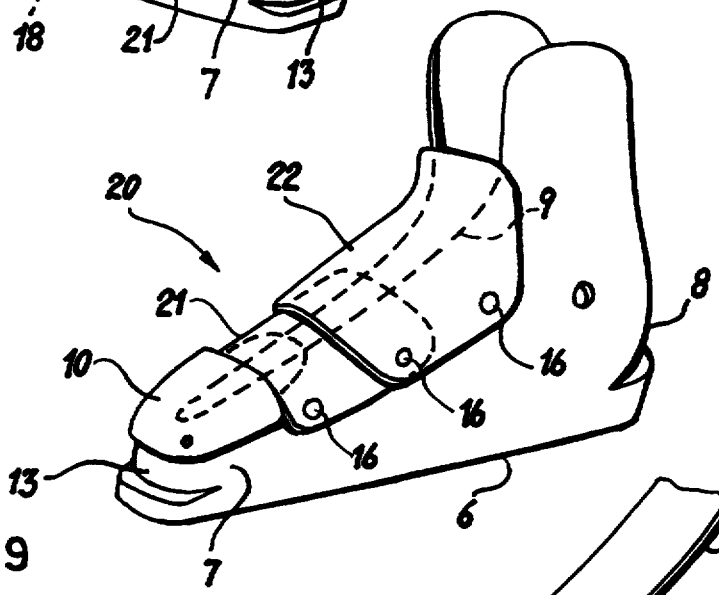

With reference to FIGS. 9 and 10, in a variation of the invention generally shown at 20, such strips may be arranged partly offset in the toe-and-heel longitudinal direction of the boot, in which case they would take the form of two partially overlapping bands 21, 22, each extending from one lateral side of the shell to the other and being fastened thereto with one end and provided with respective fastener means (whose levers are illustrated by dash lines in FIG. 10) on the other end.

In a second variation (FIG. 6) of the invention, generally shown at 30, a single strip 31 is secured to the shell along one of the notch 9 edges and extends past the opposite edge to overlie said notch.

Figure 11:
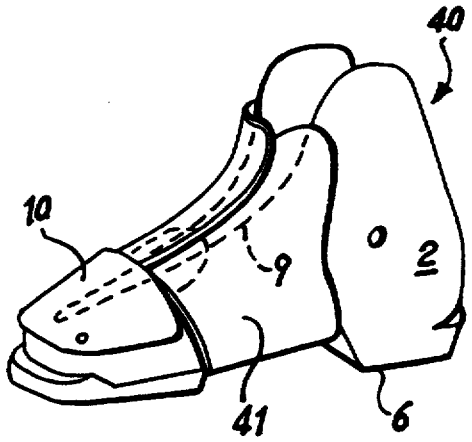
FIG. 11 is a perspective view of another embodiment of the invention in the assembled state of FIG. 4.

In a third variation of the invention (FIG. 11), generally shown at 40, said strips are formed on the opposite ends of a single band element 41 which girdles the shell 2 and is passed under the sole 6. Here again, fastener means, not shown, are provided.

In the manufacture of a ski boot according to the invention, the shell may be formed from specially stiff lightweight materials. In any case, the shell can be clamped properly onto the wearer's foot by virtue of the deep extent of the notch 9 toward the toe end. As for the construction of the strips 14, 15 or their equivalent components just described, different materials may be selected which be significantly more pliable than those used in the shell construction. This feature is afforded by that the aforesaid strips are added to the shell rather than an integral construction therewith. Such strips could also be molded integrally with the shell, however.

Thus, the invention does solve the proposed problem and affords a number of advantages. First, the water seepage problem is solved because an evener fit of the strips and the toe piece all around the pertinent periphery of the notch can be achieved.

In addition, a lightweight inexpensive shell with overlapping strips can be provided using a variety of materials such as polypropylene instead of the conventional polyurethane, which is softer but also heavier and more expensive.

I claim:

1. A sport shoe comprising:

a shell having longitudinally opposed toe and heel regions, an instep region, an entrance port, and a notch formed in the instep region extending from said entrance port to the vicinity of the toe region, a bootleg encircling said entrance port, and closure means for partially covering said notch, said closure means comprising, at said toe region, a toe piece having an inner and outer surface, said inner surface directly overlying the shell in substantially mating contact with the toe region, said toe piece having a lug projecting towards said heel region, said closure means further comprising, at said instep region, intermediate between said toe region and said entrance port, at least one flap bridging said notch and fastened onto said shell so as to close said notch, said at least one flap partially extending under said bootleg and said lug of said toe piece intervening in use between the said at least one flap and the shell to clamp said toe piece onto the shell through said flap.

2. A sport shoe according to claim 1, wherein said notch extends in said shell beneath said toe piece.

3. A sport shoe according to either claim 1, wherein said notch diverges away from the toe region.

4. A sport shoe according to claim 1, wherein the toe piece is secured to the shell by a means for oscillation toward and away from said notch.

5. A sport shoe according to claim 1, wherein said at least one flap is added to said shell.

6. A sport shoe according to claim 1, wherein said at least one flap is attached to said shell.

7. A sport shoe according to claim 1, wherein said shell and said at least one flap are formed from plastics having different mechanical properties.

* * * * *